United States Patent [19]

Wong et al.

[11] Patent Number: 4,788,515

[45] Date of Patent: Nov. 29, 1988

[54] DIELECTRIC LOADED ADJUSTABLE PHASE SHIFTING APPARATUS

[75] Inventors: Mon N. Wong, Torrance; Donald C. D. Chang, Thousand Oaks, both of Calif.

[73] Assignee: Hughes Aircraft Company, Los Angeles, Calif.

[21] Appl. No.: 158,016

[22] Filed: Feb. 19, 1988

[51] Int. Cl.[4] ..... H01P 1/18; H01P 9/00

[52] U.S. Cl. ..... 333/160; 333/156; 343/778

[58] Field of Search ..... 333/160, 159, 157, 156, 333/245, 263; 343/776–778

[56] References Cited

U.S. PATENT DOCUMENTS

| | | | |
|---|---|---|---|
| 2,615,958 | 10/1952 | Phillips | 333/160 X |
| 2,775,741 | 12/1956 | Corbell | 333/159 |
| 4,616,195 | 10/1986 | Ward et al. | 333/160 |

OTHER PUBLICATIONS

"A New Technique in Ferrite Phase Shifting for Beam Scanning of Microwave Antennas", *Proceedings of the IRE*, Nov. 1957, pp. 1510–1517.

*Primary Examiner*—Marvin L. Nussbaum
*Attorney, Agent, or Firm*—Mark J. Meltzer; A. W. Karambelas

[57] ABSTRACT

An adjustable phase-shifting apparatus for use in shifting the phase of a microwave signal transmitted along a TEM transmission line, such as coaxial line whose inner and outer conductors have square cross-sections. The apparatus includes a body with an elongated cavity therein which forms part of the outer conductor, and a cover attached to the body which forms at least part of the outer conductor. The cover has at least one pair of elongated openings that provide access to a portion of the cavity. The apparatus also includes a movable member provided with at least one pair of elongated, tapered, dielectric-loaded projections that slidably pass through the elongated openings and are positionable about either side of the center conductor to provide an adjustable phase lag. A digital or analog actuator, such as a solenoid or motor driven cam, is provided to slide the projections in and out of the cavity in a direction normal to the signal's direction through the cavity to enable adjustment of the phase lag or shift. Multiple pairs of openings in the cover and corresponding pairs of dielectric projections may be used along a common extended cavity in the body to provide a series of selectable phase shifts in a single apparatus. A pair of such phase shifters may be interconnected by a see-saw linkage so that the phase shifts produced by the shifters are equal but opposite. Several such interconnected pairs of phase shifters may be used to provide the phase shifts required in a phased array antenna.

26 Claims, 7 Drawing Sheets

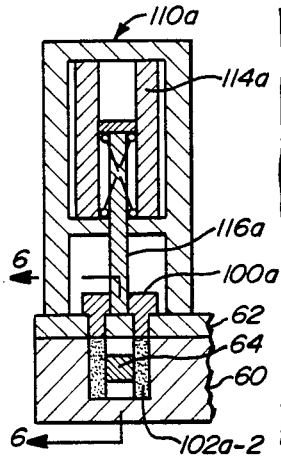
FIG. 5
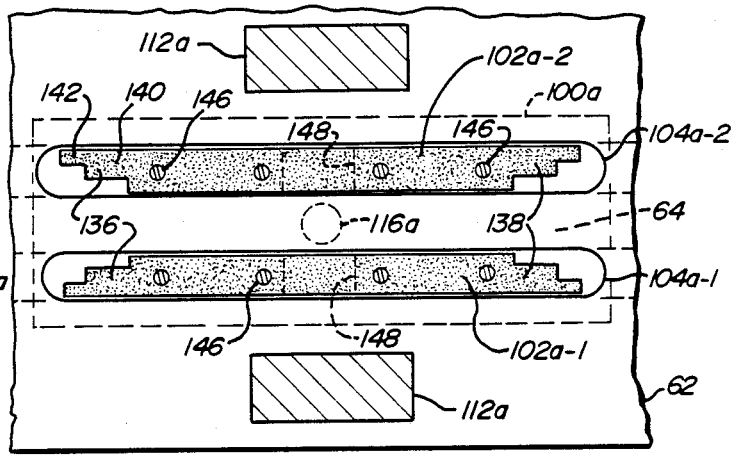
FIG. 4
FIG. 6
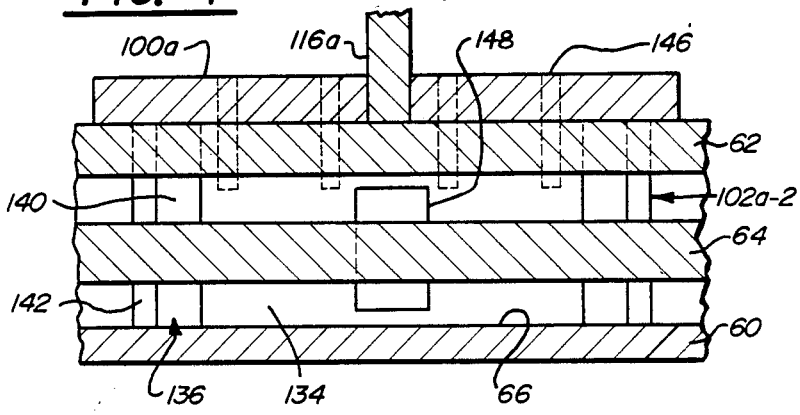
FIG. 14
215
214
| ROW NO. | STATE OF BITS: BIT 3 (MSB) -180° | BIT 2 -90° | BIT 1 (LSB) -45° | OUTPUT: TOTAL PHASE SHIFT |
|---|---|---|---|---|
| 0 | 0 | 0 | 0 | 0° |
| 1 | 0 | 0 | 1 | -45° |
| 2 | 0 | 1 | 0 | -90° |
| 3 | 0 | 1 | 1 | -135° |
| 4 | 1 | 0 | 0 | -180° |
| 5 | 1 | 0 | 1 | -225° |
| 6 | 1 | 1 | 0 | -270° |
| 7 | 1 | 1 | 1 | -315° |

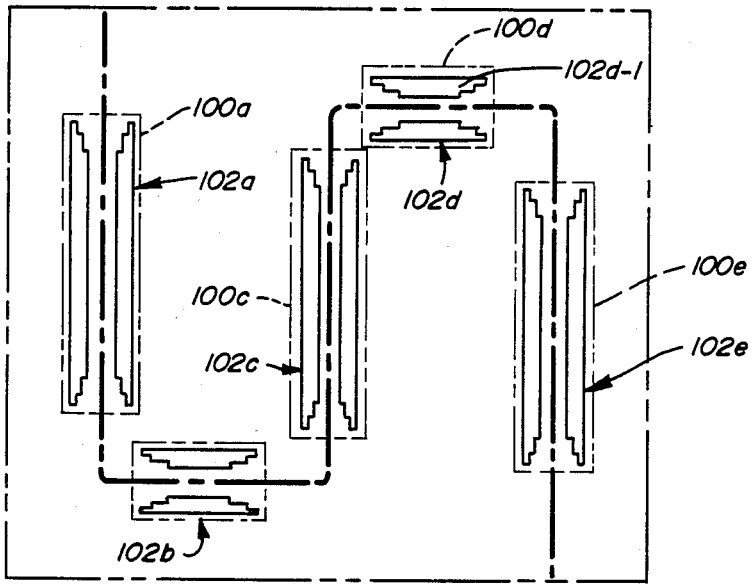
FIG. 11
FIG. 12
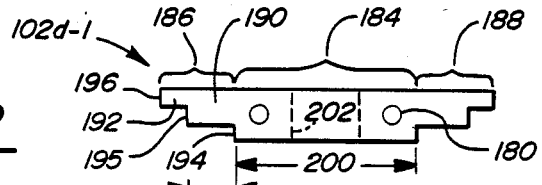
FIG. 13
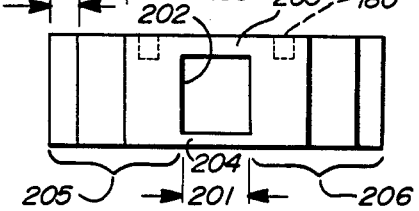

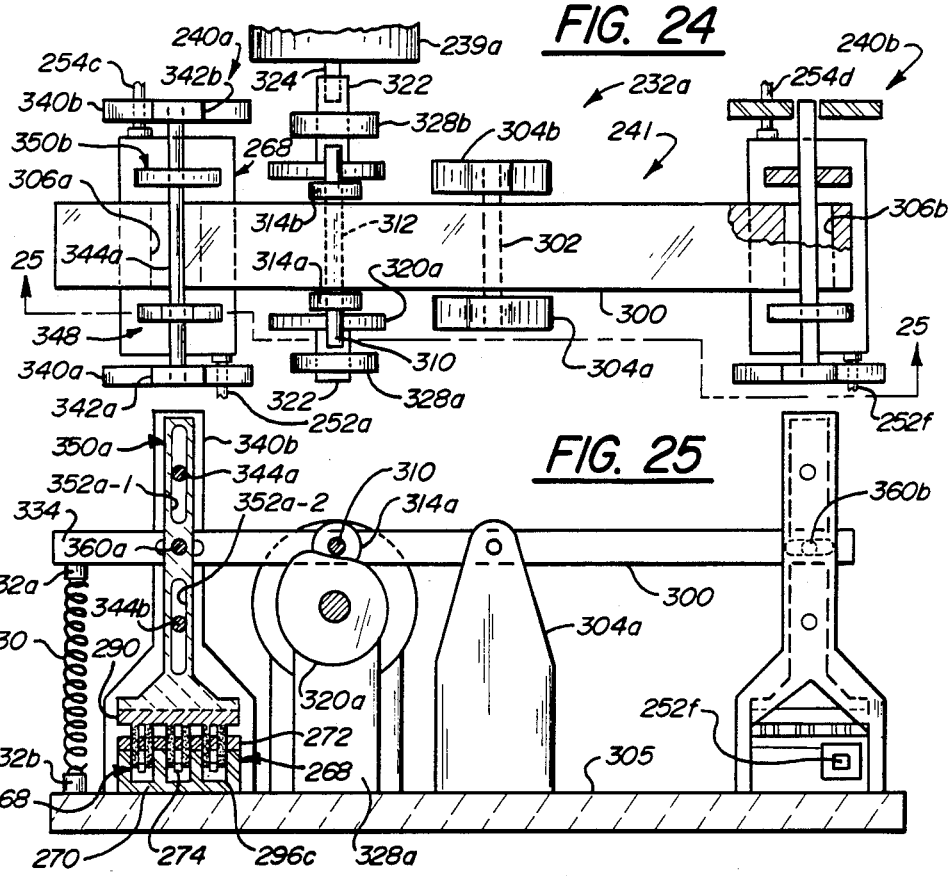
FIG. 24
FIG. 25
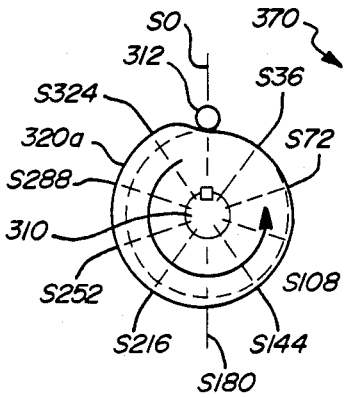
FIG. 26
| ROW NO. | POSIT. (STEP) NO. | MECH. ANGLE OF CAM | DIAM. OF CAM (INCHES) | ELECTR. PHASE A ($\phi$A2) | ELECTR. PHASE B $\phi$B1 |
|---|---|---|---|---|---|
| 0 | S0 | 0° | .750 | 0° | 0° |
| 1 | S36 | 36° | .750 | 0° | 0° |
| 2 | S72 | 72° | .7813 | 22.5° | -22.5° |
| 3 | S108 | 108° | .8125 | 45° | -45° |
| 4 | S144 | 144° | .8438 | 67.5° | -67.5° |
| 5 | S180 | 180° | .875 | 90° | -90° |
| 6 | S216 | 216° | .9063 | 112.5° | -112.5° |
| 7 | S252 | 252° | .9385 | 135° | -135° |
| 8 | S288 | 288° | .9698 | 157.5° | -157.5° |
| 9 | S324 | 324° | 1.000 | 180° | -180° |
FIG. 27

DIELECTRIC LOADED ADJUSTABLE PHASE SHIFTING APPARATUS

BACKGROUND OF THE INVENTION

1. Field of the Invention

This invention relates in general to microwave phase-shifting apparatus and in particular to phase shifters with either digital or analog control mechanisms for use with microwave signals being transmitted over transverse electromagnetic lines.

2. Description of Related Art

A phase shifter may be generally defined as a two-port microwave device which is used to control the phase of a signal passing therethrough. Many types of phase shifters are known including diode phase shifters of the constant time delay type and the constant phase shift type, and ferrite phase shifters which are generally made by placing ferrite materials in a section of wave guide. Ferrite phase shifters can be either of a reciprocal or non-reciprocal type, depending upon the applied DC magnetic bias and the configuration. In such devices the phase-shifting is accomplished by changing the magnetic permeability of the ferrite material by altering the external applied DC magnetic field. A solenoid made by winding several hundred or thousand turns of wire about a rectangular waveguide section often is used to supply a longitudinal magnetic field in such devices. One such ferrite phase-shifting device is described in F. Reggia & E. Spencer, "A New Technique in Ferrite Phase Shifting For Beam Scanning of Microwave Antennas", *Proceedings of the IRE,* November, 1957, pp. 1510–1517. The characteristics of such ferrite shifters are now well-known in the art, and they are often used in many phased array antenna systems for beam scanning.

The ferrite phase shifters in comparison with a diode phase shifter has two primary advantages, namely higher power handling capability, and lower insertion loss because of the waveguide configuration. However, such ferrimagnetic microwave phase shifters also have the following disadvantages: (1) a high DC power consumption; (2) a relatively high temperature sensitivity; (3) relatively heavy-weight per unit power handling capability; and (4) relatively high insertion loss, especially if the input signal is increased beyond a certain power level.

Another type of phase shifter sometimes used in microwave circuits, at least in laboratory set-ups, is a piece of dielectric film placed in a portion of a hollow waveguide. These phase shifters operate on the principle that the propagation velocity of microwave energy passing through a medium is decreased, in comparison to its velocity through air, by the ratio $1/\epsilon^{\frac{1}{2}}$, where $\epsilon$ is the dielectric constant of the mdeium relative to the air. The extra transit time required by a microwave signal of a given frequency to pass through a predetermined length of the medium in comparison to time required to pass through an equivalent length of hollow, air-filled waveguide, provides a negative phase shift whose value is proportional to the given frequency.

Recently, a new coaxial phase shifter for transverse electromagnetic line was developed at Hughes Aircraft Company, the assignee of the present invention. This phase shifter, constructed in line with the inner conductor of the transmission line by using an interdigitated finger design, is very compact and does not require alteration of the transmission line's outer conductor to implement. This phase shifter is fully described in U.S. Pat. No. 4,616,195, granted Oct. 7, 1986 to R. Ward et al. The disclosed phase shifter is preferably used for a "squarax" transvere electromagnetic (TEM) transmission line that is a coaxial transmission line whose inner and outer conductors are square in cross-section. The phase shifter has the advantage of being a very compact and non-complex structure with a low voltage standing wave ratio (VSWR). The patent discloses that the amount of phase-shifting of the signal being transmitted selectively varied by altering the spacing between the in-line fingers extending toward one another from the left and right segments of the inner conductor. It also discloses that phase shifts larger than those provided by one phase shifter of the kind just described may be achieved by cascading two or more separate phase shifters in series with each other. However, this patent does not disclose any technique for providing, with this phase shifter, a mechanically or electrically adjustable phase shifter to a microwave signal being transmitted therethrough.

In many microwave applications, such as phased array antenna systems used in ground or space-based locations, it is necessary to provide a phase shifter which is adjustable. The ferrite phase shifters previously described may be automatically adjusted, but they still suffer from the aforementioned disadvantage.

Another type of adjustable phase shifter often used to adjust the electrical separation of microwave components without introducing additional impedance mismatch are line stretchers. These devices include one or more hollow telescoping pairs of metallic tube whose overall length can be physically changed by sliding the inner tube further into or out of the outer tube. However, they generally are physically quite large in size and, as far as we are aware are simply manually adjusted to the desired length and then locked down or tightened up to prevent further movement.

It would be most advantageous to have a compact, relatively lightweight, adjustable phase-shifting apparatus that can be automatically operated for various microwave circuit applications, such as phased array antenna systems, and particularly for space applications where low weight, low power consumption and simplicity are highly valued.

The object of the present invention is to overcome the foregoing disadvantages of ferrite phase shifters, and to provide an adjustable phase-shifting apparatus which is relatively light weight, inexpensive and simple to operate. Other objects of the present invention includes: providing a phase-shifting apparatus suitable for use with squarax transmission line, providing a phase-shifting apparatus which may be automatically controlled digitally or in an analog fashion; providing a phase-shifting apparatus which may selectively provide multiple phase shifts of different values in response to external commands; and providing an interconnected pair of phase shifters operated by a mechanical linkage which produce equal but opposite phase shifts in a pair of microwave signals, for applications such as a phased array antenna.

SUMMARY OF THE INVENTION

In light of the foregoing objects, there is provided in accordance with one aspect of the present invention, an adjustable phase-shifting apparatus for use in shifting the phase of a microwave signal being transmitted along a transverse electromagnetic transmission line of the type including an inner conductor, a coaxial outer conductor, and a first dielectric located between the conductors. This apparatus comprises: a body having an elongated cavity therein which forms at least part of the outer conductor; cover means attached to the body, for forming at least part of the outer conductor, and having at least a first elongated opening therein which provides access to at least a first portion of the cavity; and first member means for altering the phase of the signal as it passes through the first portion of the cavity. The first member means is provided with at least a first section including a second dielectric that is movable with respect to the first portion of the cavity in a direction transverse to the direction of the signal as it passes through the first portion of the cavity to alter the phase of the signal. This apparatus may most advantageously be used with a transmission line whose first dielectric is primarily either a gas such as air or vacuum, and whose inner and outer conductors have substantially square cross sections. However, the first and second dielectrics may alternatively be any conventional or suitable solid insulative material or a combination or composition of such materials. The first section of the member means preferably is elongated and has a pair of thin elongated projections or slabs substantially parallel to and spaced apart from one another which are insertable on opposite sides of at least a first segment of the center conductor, which segment is located within the first portion of the cavity. The cover means preferably includes at least a first pair of spaced elongated openings parallel to one another and sized to accommodate snugly the projections, and the member means includes a support plate having a substantially planar surface from which the projections perpendicularly extend, which is located on the side of the cover means opposite the cavity. Each projection has a central region and a pair of opposed end regions, with each of the end regions being tapered outwardly from the central region to thereby reduce the abruptness of the transition for the signal as the signal passes between the dielectric in the projections.

According to a second aspect of the present invention, there is provided a phase-shifting apparatus for selectively imparting, in response to at least first and second input commands, a plurality of non-zero phase shifts to a microwave signal being transmitted along a TEM transmission line of the type including substantially square inner and outer conductors and a gas of vacuum dielectric located therebetween. The apparatus comprises: a body having an elongated cavity therein which forms part of the outer conductor; and cover means, attached to the body, for forming part of the outer conductor, having at least first and second spaced pairs of elongated openings which respectively provide access to first and second spaced portions of a cavity, with each elongated opening spaced closely to and extending generally parallel to the other opening of its pair. The apparatus is also comprised of first phase change means for selectively altering, in response to the first command, the phase of the signal as the signal passes through the first portion of the cavity. This first phase change means includes a movable structure having at least a first section provided with a support region and at least two thin elongated projections or slabs includes dielectric material which extend transversely from the support region and into respective openings of the first pair of openings in the cover means. These projections are movable between two distinct positions with respect to the first portion of the cavity in a direction transverse to the direction of the signal passing through the first portion of the cavity to alter the phase of the signal. The apparatus also includes second phase change means for selectively altering, in response to the second command, the phase of the signal s the signal passes through the second portion of the cavity. The second phase change means includes a movable structure having at least a first section provided with a support region and two thin elongated projections including dielectric material which extend transversely from the support region and into the respective openings of the second pair of openings in the cover means, the projections of the second phase means being movable between two distinct positions with respect to the second portion of the cavity in a direction transverse to the direction of the signal as it passes through the second portion of the cavity to alter the phase of the signal. The first and second phase change means may include electrically operated actuator means for moving their respective movable structures between their respective two distinct positions.

According to a third aspect of the present invention, there is provided a phase-shifting apparatus which is controllable in an analog manner, rather than in or in addition to the digital manner as described above in the second aspect of the invention. The apparatus of the third aspect comprises a structure having an elongated cavity therein which forms at least part of the outer conductor through which at least a first segment of the inner conductor passes and having at least a first elongated opening therein which provided access to at least a first portion of the cavity. The apparatus also comprises first means for altering the phase of the microwave signal as it passes through the first portion of the cavity. The first means is provided with at least a first section including dielectric material that is movable with respect to the first portion of the cavity through multiple positions forming a substantially continuous range of positions to alter the phase of the signal, with such movement being in a direction transverse to the direction of the signal as it passes through the first portion. The apparatus also comprises control means for selectively placing the first section of the first member means in any predetermined one of the positions within the substantially continuous range of positions in response to an external command specifying such predetermined position.

According to a fourth aspect of the present invention, an improved phase-shifting mechanism for use in simultaneously shifting the phase of at least first and second microwave signals being transmitted along first and second distinct transverse electromagnetic transmission lines of the type including an inner conductor, a coaxial outer conductor and a first dielectric located between the conductors. This improved phase-shifting mechanism is preferably used in a phased array antenna system of the type having an array of radiating elements spaced from one another in a predetermined manner, and a signal distribution network having a first port and a plurality of second ports. The improved phase-shifting mechanism is used to provide the incremental time delays or phase shifts required for antenna beam scanning in the phased array antenna system. The improvement in the phase-shifting apparatus comprises in combination: (a) a first phase-shifting apparatus including (1) a first structure through which at least the first portion of the first transmission line passes, provided with at least a first opening providing access to at least part of the volume of the first portion of the first transmission line and (2) first means for altering the phase of the first signal as it passes through the first portion of the first transmission line, the first means being provided with at least a first section including dielectric material that is movable with respect to the first portion of the first line in a first direction transverse to the direction of the first signal as it passes therethrough. The improvement also comprises (b) a second phase-shifting apparatus including (1) a first structure through which at least a first portion of the second transmission line passes, provided with at least a first opening provided access to at least part of the volume of the first portion of the second transmission line, and (2) first means for altering the phase of the second signal as it passes through the first portion of the second transmission line, the first means being provided with at least a first section including dielectric material that is movable with respect to the first portion of the second line in a second direction transverse to the direction of the second signal as it passes therethrough. Finally, the improved apparatus also comprises (c) mechanical means for connecting the first and second member means together for simultaneous movement so that changes in phase shifts in the first and second signals passing through the first and second portions are substantially equal but opposite to one another. The mechanical means may include a seesaw linkage structure having a lever pivotable about a first axis and having first and second sections on opposite sides of the first axis.

These and other aspects, objects, features and advantages of the present invention will be more fully understood from the following detailed description taken in conjunction with the drawings and appended claims.

BRIEF DESCRIPTION OF THE DRAWINGS

In the accompanying drawings, where identical reference numerals in the various Figures refer to like items or features:

FIG. 4 is a fragmentary top sectional view of the FIG. 3 apparatus taken along line 4—4 of FIG. 2;

FIG. 5 is the same view as FIG. 3, except that the solenoid actuator, support bar and projections of the FIG. 2 apparatus is shown in a fully lowered or inserted position;

FIG. 6 is an enlarged side sectional view of the FIG. 5 apparatus taken along line 6—6 of FIG. 5;

FIG. 11 is a plan view which shows the location and size of the five pairs of phase change projections relative to the body and center line of the inner conductor of FIG. 7 which are indicated in phantom in FIG. 11;

FIGS. 12 and 13 are top and side elevational views respectively of a single projection of a pair of projections designed to produce a −22.5 degree phase shift in the center of the C ban range of microwave frequencies;

FIG. 14 is a truth table to help explain how the FIG. 1 phase shifter may be operated as a three-bit phase shifter to provide eight possible phase shift values;

FIG. 24 is a plan view of one of the dual phase shifters shown in block diagram form in FIG. 15;

FIG. 25 is a side elevational view of the FIG. 24 phase shifter shown in partial cross-section taken along line 25—25 of FIG. 24;

FIG. 26 is an enlarged side elevational view of one of the two identical mechanical cams employed in the FIG. 24 phase shifter; and FIG. 27 is a table to help explain the operation of the FIG. 24 phase shifter including the role of the mechanical cam illustrated in FIG. 26.

DETAILED DESCRIPTION OF THE PREFERRED EMBODIMENTS

Figure 1:
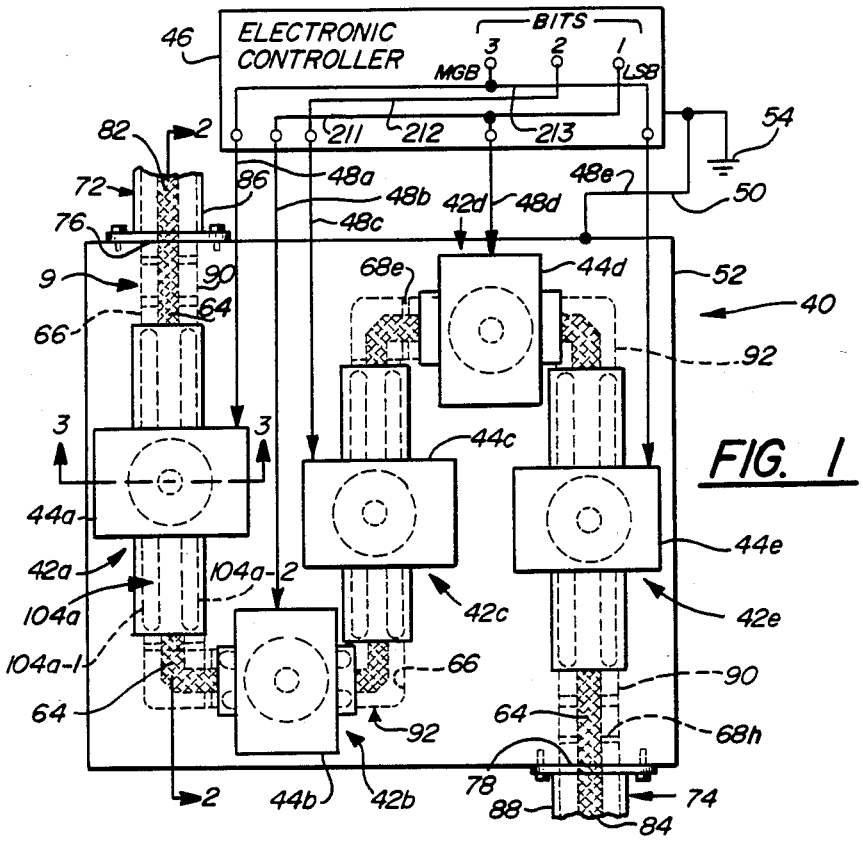
FIG. 1 is a plan view of a digitally controlled phase shifter of the present invention which employs five serially arranged phaseshifting apparatuses of the present invention, each of which include a solenoid-operated actuator.
Figure 2:
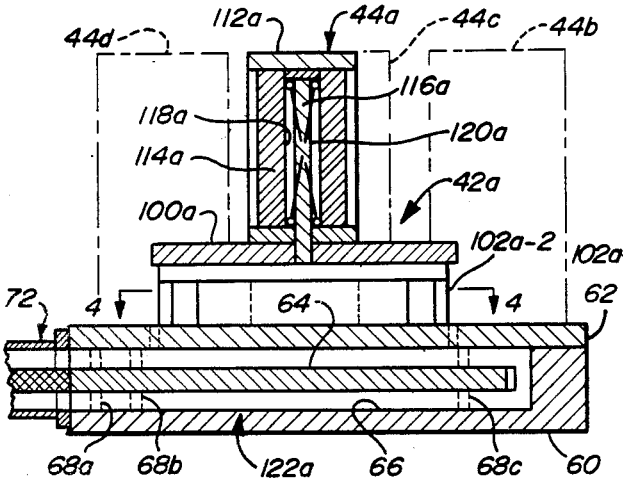
FIG. 2 is a side sectional view of the FIG. 1 phase shifter taken along line 2—2 of FIG. 1, illustrating a typical phase-shifting apparatus, and showing its solenoid-operated actuator, support bar and dielectric-loaded phase change projections, in a fully raised or withdrawn position.

Referring now to FIGS. 1 and 2 a digitally controlled phase shifter 40 of the present invention is shown which employs five serially arranged phase-shifter apparatuses **42*a*–42*e* of the present invention, each of which includes one of the solenoid-operated actuators 44*a*–44*e*. The actuators 44*a*–44*e* are operated in accordance with electrical command signals received from an electronic controller 46 of conventional design and construction over conductors 48*a*–48*e*. Conductor 50 provides a conductive path between the base structure 52 of the phase shifter 40 upon which the actuators 44 are mounted to ground 54. The base 52 includes, best shown in FIG. 2, a body 60, a slotted cover plate 62, an S-shaped inner conductor 64 located within a correspondingly shaped cavity 66 in the body 60, and a plurality of dielectric spacers 68*a*–68*h* which support the inner conductor 64 in the center of the cavity 66. More will be said about each of these components of the phase shifter 40** later.

FIGS. 1 and 2 also show square inner and outer transverse electromagnetic (TEM) transmission lines 72 and 74 respectively connected at suitable connectors or ports 76 and 78 to the TEM line in the base 52 of the phase shifter 40. The TEM lines 72 and 74 have square cross-sections and respectively include inner conductors 82 and 84, coaxial outer conductors 86 and 88, and an air or vacuum dielectric located between the inner and outer conductors. The outer conductor 90 of TEM line 92 in the phase shifter 40 is formed by the metallized surfaces of the cavity in body 60 and the corresponding portion of the cover 62 thereabove, while inner conductor of TEM line 92 is conductor 64. The TEM line 92 also has square cross-sections, and is serially connected to TEM lines 72 and 74, so that a suitable microwave signal may be transmitted through the phase shifter 40 in either direction, that is from line 72 to line 74 or vise versa. The inner conductors 64, 82 and 84 are cross-batched in FIG. 1 for each of identification.

The body 60 and cover 62 of the base 72 are preferably made of metal, so that the S-shaped cavity 66 formed in the body 60, in conjunction with the corresponding section of the mtal cover 62 directly thereabove form a square outer conductor. The S-shaped inner conductor 64 is preferably made of a highly conductive metal and is suitably electrically connected to and represents a direct electrical interconnection between continuation of the inner conductors 82 and 84 of TEM lines 72 and 74. The five phase-shifting apparatuses 42*a*–42*e* are serially arranged directly above the outer conductor 90 within the phase shifter 40 and may be individually operated to impart a specific phase shift to a microwave signal passing therethrough in a manner which will be shortly described.

As best shown in FIG. 2, a typical phase shifting apparatus 42*a* includes a solenoid-operated actuator 44*a*, including a metal support bar 100*a* to which is attached a pair 102*a* of thin elongated dielectricloaded phase change projections 102*a*-1 and 102*a*-2 that are sized to pass through a pair 104*a* of openings 104*a*-1 and 104*a*-2 in the cover 62. The support bar 100*a* and projections 102*a* may be raised and lowered by the solenoid actuator 44*a*, which includes a solenoid assembly consisting of a frame 112*a*, a solenoid coil 114*a* and a solenoid shaft 116*a* coaxially positioned in the bore 118*a* of solenoid coil 114*a* and biased upwardly by helically wound return spring 120*a* coiled about the shaft 116*a* in the bore 118*a*, as shown. The solenoid shaft 116*a* is rigidly connected to the support bar 100*a*. Energization of the coil 114*a* by a suitable signal applied via conductor 48*a* causes the solenoid shaft 116*a* to be lowered against the bias of spring 120, so that the projections 102*a* are lowered into the cavity 66, as is best shown in FIGS. 5 and 6 to be discussed shortly.

Figure 3:
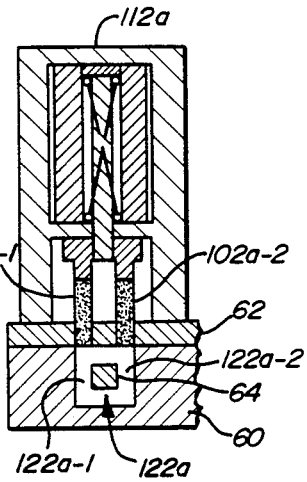
FIG. 3 is a fragmentary front sectional view of the FIG. 2 apparatus taken along line 3—3 of FIG. 1.

FIG. 3 shows a front sectional view of the phase shifting apparatus 44*a* taken along line 3—3 in FIG. 1. As shown in FIGS. 2 and 3, the projections 102*a* are poised in a fully raised and retracted position above a selected portion 122*a* of the cavity 66 in the body 60. The thickness of the individual projections 102 are selected so that they fit snugly into the spaces 122*a*-1 and 122*a*-2 on opposite sides of the square center conductor 64 when the coil 114*a* is energized.

FIG. 4 is a fragmentary top sectional view of the phase shifting apparatus 42*a* taken along line 4—4 in FIG. 2 which shows the tapered longitudinal cross-section of the projections 122*a*-1 and 122*a*-2 relative to the center conductor 64 and elongated slots 104*a* in the cover 62. The elongated slots 104*a* have a transverse dimension approximately the same size as the side portions 122*a*-1 and 122*a*-2 of the selected cavity portion 122*a*, and slightly larger than the corresponding thickness of the dielectric projections 102*a*-1 and 102*a*-2, as shown. Similarly, the length of the slots 104*a* is just slightly longer than the length of the projections 102*a*. This ensures that the projections 102 are slidable into and fit snugly within the openings 104*a* and the side spaces 122*a*-1 and 122*a*-2 of the cavity portion 122*a*.

FIGS. 5 and 6 show front sectional views and cross-sectional views respectively of portions of phase-shifting apparatus 42*a* when the solenoid actuator 44*a* is energized, which places the projections 102*a* in their fully lowered position. When the projections 102*a* are in this position, the propagation velocity of the microwave signal being transmitted through portion 122*a* of the line 92 is reduced by the ratio $1/\epsilon^{\frac{1}{2}}$, where $\epsilon$ is the effective dielectric constant of the cavity portion 122*a* when the projections 102*a* are fully lowered into the cavity. In a preferred embodiment of the present invention, the projections 102 and the dielectric spacers 68 are all made of a dielectric material having excellent mechanical strength and high temperature stability and a relatively high dielectric constant value. A preferred material for the projections is ULTEM 1000 thermoplastic resin material available from the Plastics Division of the General Electric Company, which has a dielectric constant equal to 3.10. As is explained above, the reduced propagation velocity through the dielectric material in comaprison to the propagation velocity through a gas such as air or a vacuum causes the signal to be time delayed in proportion to the length of the dielectric material through which the signal passes, which results in a predictable phase shift for a signal of known frequency. A usable predictable phase shift is obtained by lowering the projections 102*a* into the cavity portion 122*a* even through the spaces 130 and 132 of cavity portion 122*a* above and below the center conductor 64 do not contain any of the dielectric material of the projections.

FIGS. 4 and 6 show that the projections 102*a* have a central region 134 of uniform thickness and rectangular cross-section and a pair of opposed end regions 136 and 138, with each of the end regions being tapered outwardly from the central region 134 in stair-step fashion. This construction reduces the abruptness of the transition for a microwave signal as the signal passes from the gas or vacuum dielectric and the projections 122. The end regions 136 and 138 each include a plurality of contiguous steps or segments such as segments 140 and 142 shown in FIG. 4 having distinctly different, substantially uniform thicknesses, with each successive segment further from the central region 134 being less thick than the segments closer to the central region.

In FIGS. 4 and 6 suitable fastening means such as nylon set screws 146 may be used to connect the metal support bar 100*a* to the projections 102. These may be placed in pre-tapped holes made for this purpose. Alternatively, the support plate 100*a* and the projections 102*a* could be fabricated as one piece from a dielectric material using well-known plastic injection molding techniques. Each of the projections 102 may also include a rectangular aperture like aperture 148 whose purpose is explained later.

Figure 7:
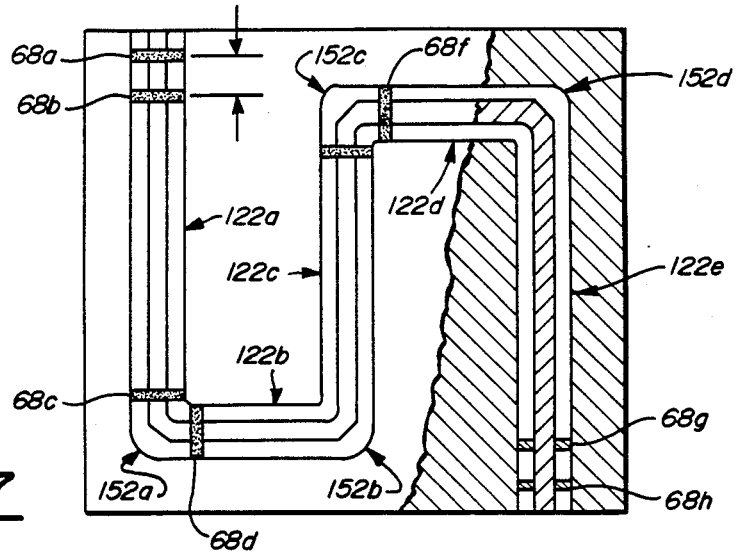
FIGS. 7 and 8 are top and front views respectively of the body inner conductor and part of the outer conductor of the FIG. 1 phase shifter.
Figure 8:
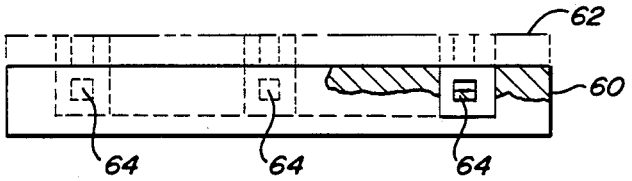

FIGS. 7 and 8 are top and front detail views of the body 60 of phase shifter 44, with the inner conductor 64 and dielectric spacers 68 for centering and supporting the inner conductor shown therein within cavity 66. The right-hand portion of FIG. 7 is broken away to further illustrate the construction of the body. The cavity 66 has a rectangular S-shape including five stright portions 122*a*–122*e* and four 90 degree turn portions 152a–152d. The three longer straight portions 122a, 122c and 122e are each separated by a pair of turn portions which provide 180 degrees of direction change such that the path of transmission line within the base 52 reverses direction twice. Also, the two shorter straight portions 122b and 122d enable the longer straight portions 122a, 122c and 122e to be spaced apart, enabling the three phase shifting apparatuses 44a, 42c and 42e to be placed roughly horizontal in line across the phase shifter 40 as shown in FIG. 1. In phase shifter 40, the shorter straight portions 122b and 122d of the cavity are also used to provide smaller phase shifts via phase-shifting apparatuses 42b and 42d as will be further explained. Those in the art will appreciate that it is the S-shaped transmission line design which permits phase shifter 40 to have its compact three-dimensional size as shown in FIGS. 1 and 2 which is desirable or necessary in some microwave circuit applications. Those skilled in the art should readily appreciate, however, that an in-line design could be also used where an elongated structure having a TEM line passing therethrough has a plurality of phase shifting apparatuses 42 placed in line about the cavity.

The dielectric spacers 68 are arranged in four pairs, as best shown in FIG. 7. The center-to-center distance between the individual spacers in any given pair is one-quarter wave length of the center frequency of the frequency band for which the phase shifter 40 is designed. For example, the dimension 158 between spacer 68a and 68b is one-quarter wave length. A fewer or greater number of pairs of dielectric spacers could be used, as required or desired, to support the center conductor against movement relative to the cavity. In FIG. 8, the cover 62 is shown in phantom for convenient reference.

Figure 9:
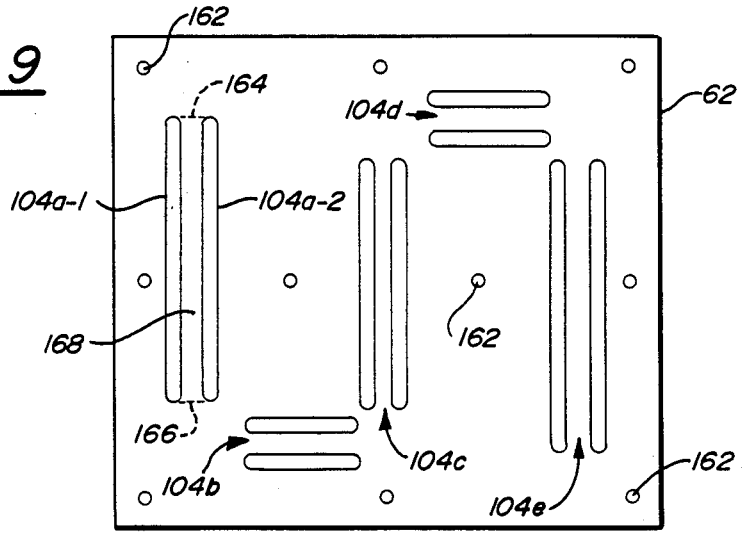
FIGS. 9 and 10 are top and side views respectively of the cover of the FIG. 1 phase shifter.
Figure 10:
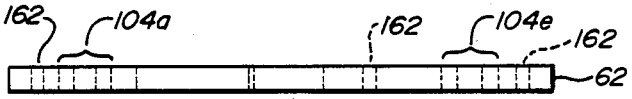

FIGS. 9 and 10 are top and front detail views respectively of the cover 62 showing the five pairs of elongated slots 104a–104e placed in the cover in locations corresponding to the cavity 66 which is positioned therebelow when the cover 62 is fastened to the body 66. The cover 62 may be fastened to the body in any suitable or conventional manner such as by machine screws placed in 11 locations 162 shown in dotted lines in FIG. 9. The body 60 and cover 62 are preferably made out of any conventional or suitable metal, for example copper or aluminum alloys, meeting the structural weight and environmental requirements of the application to which the phase shifter 40 will be placed. In certain applications which place a premium upon light-weight components, such as aviation or space applications, it is preferable to make the body 60 and cover 62 out of lightweight rigid, high temperature plastic or other synthetic materials, and simply coat the cavity 68 and the portions of the cover 62 thereabove with a suitable layer of conductive material such as copper by RF sputtering or any other suitable deposition technique in order to provide the outer conductor 90 of transmission line 92 used in base 52. Such construction details are well -known to those skilled in the art and need not be discussed further here.

Although, as shown in FIG. 10, it is preferred to provide a pair of elongated openings, such as openings 104a-1 and 104a-2, for each phase shifting apparatus, such as apparatus 42a, those skilled in the art will appreciate that it is possible to provide a single opening 104a by removing the center portion 168 between the dotted lines 164 and 166 and the pair of openings 104a-1 and 104a-2. A single opening is not preferred since it allows additional energy to escape from the cavity during operation of the phase shifter 44.

FIG. 11 is a plan view showing the outline of the body 60, the center line 174 of the inner conductor 64 and the support bars 100a–100e in phantom in order to illustrate the location and size of the five pairs 102a–102e of phase change projections relative thereto. In a preferred embodiment of the phase shifter 44, the size and length of the pairs 102 of projections are selected relative to the center of the frequency band of interest so that phase change projection pairs 102a, 102c and 102e each provide a −90 degree phase lag at the center band frequency and the phase change projection pairs 102b and 102d each provide a −22.5 degree phase shift.

FIGS. 12 and 13 are top and side elevational views respectively of a typical single projection such as projection 102d-1 of projection pair 102d. Tapped holes 180 are provided for fastening the projection 102d-1 to its support bar or plate 100d. As in the projection pair 102a shown in FIG. 4, the projection 102d-1 contains a central region 184 and opposed tapered end regions 184 and 186. The end regions are mirror images of one another and each includes a plurality of contiguous segments having distinctly different substantially uniform thickness such as segments 190 and 192, with each segment further from the central region 184 being less thick than the segments closer to the central region. The reduction in thickness between adjacent segments is uniform so that in this stair-step design the dimension of the risers 194, 195 and 196 of the steps are equal. The longitudinal dimension 198 is twice the length of longitudinal dimension 199. The length 200 of the central region 184 is sized to be one-quarter wavelength of the nominal frequency of the microwave signal being transmitted through the TEM line 92 of the phase shifter 44. The length 201 of the rectangular aperture 202 is sized in order to produce the desired phase shift given the amount of other material present in the projection 102d-1. The connecting parts 203 and 204 of the central region 184 simply serve to keep the projection 102a-1 as a single piece of dielectric material for ease of handling and mechanical stength. If desired, projection 102a-1 may be formed as two spaced half-projections 205 and 206, by simply omitting connecting parts 203 and 204 while leaving the remainder of the projection 102a-1 in the positions shown in FIGS. 12 and 13. In the preferred embodiment of the phase shifter described above, projections 102b-1, 102b-2 and 102d-2 are made in a fashion identical to projection 102d-1 while the remaining projections, namely the projections of projection pairs 102a, 102c and 102e, are made in a similar manner, with the only differences being their somewhat longer overall length and the different length of their centrally located rectangular apertures.

The operation of the preferred embodiment of the phase shifter 40 illustrated in FIGS. 1 and 14 will now be explained. In this preferred embodiment, not all of the solenoids 114a–114e of the phase shifting apparatuses 42a–42e are operated independently. Instead as shown in FIG. 1 by the wiring within the electronic controller 46, the solenoids for apparatuses 44a and 44e are actuated by a common electrical signal provided by conductor 213, the solenoids of apparatuses 42b and 42d are operated by a common signal from conductor 211, and the solenoid of apparatus 42c is operated a signal from conductor 212. As previously explained with respect to FIG. 11, the projections of phase shifting apparatuses 42*a*, 42*c* and 42*d* in the preferred embodiment each provide a 90 degree phase lag, while the projections of phase shifting apparatuses 42*b* and 42*d* each provide a 22.5 degree phase lag when their respective solenoids are energized, and a zero degree phase lag when their respective solenoids are de-energized. Conductors 211 through 213 are respectively connected to amplifier outputs labeled Bit 1, Bit 2 and Bit 3, where Bit 1 is the least significant bit (LSB) and Bit 3 is the most significant bit (MSB).

The truth table 214 illustrated in FIG. 14 shows the total phase shift produced as the output of phase shifter 40 as a function of all eight possible combinations of states for the three bits of the input bits state. A zero entry in any one of the three input columns 215 indicates a off position due to the absence of an energizing signal on the bit output indicated, while a "1" indicates the presence of a signal to energize the solenoids connected to the bit output. When all three output states are in a logical zero condition, all five pairs of projections 104 are fully withdrawn from the cavity, and a zero degree phase shift results as indicated in row zero of the truth table 214. When as indicated in row 1, the Bit 1 output is activated, the phase shifting apparatuses 42*b* and 42*d* are simultaneously actuated, which causes their respective pairs of rejections to be fully inserted into the cavity portions 122*b* and 122*d*, resulting in two separate −22.5 degree phase shifts, for a total phase shift of −45 degrees. As indicated in row 2, when only the Bit 2 output is energized, a −90 degree phase shift results from the insertion of the projections of phase shifting apparatus 42*c* into the cavity portion 122*c* therebelow. As shown in row 4 of the table 214, when only the bit 3 output is energized, a −180 degree phase shift is produced as a result of the full insertion of the projections of phase shifting apparatuses 42*a* and 42*e* into the cavity portions 122*a* and 122*e*. The remaining rows of the tabel 214 indicate that whenever two or more of the bit outpus are simultaneously energized, the resulting total phase shift is the sum of the individual phase shifts resulting from the energization of the individual bit outputs involved.

Figure 15:
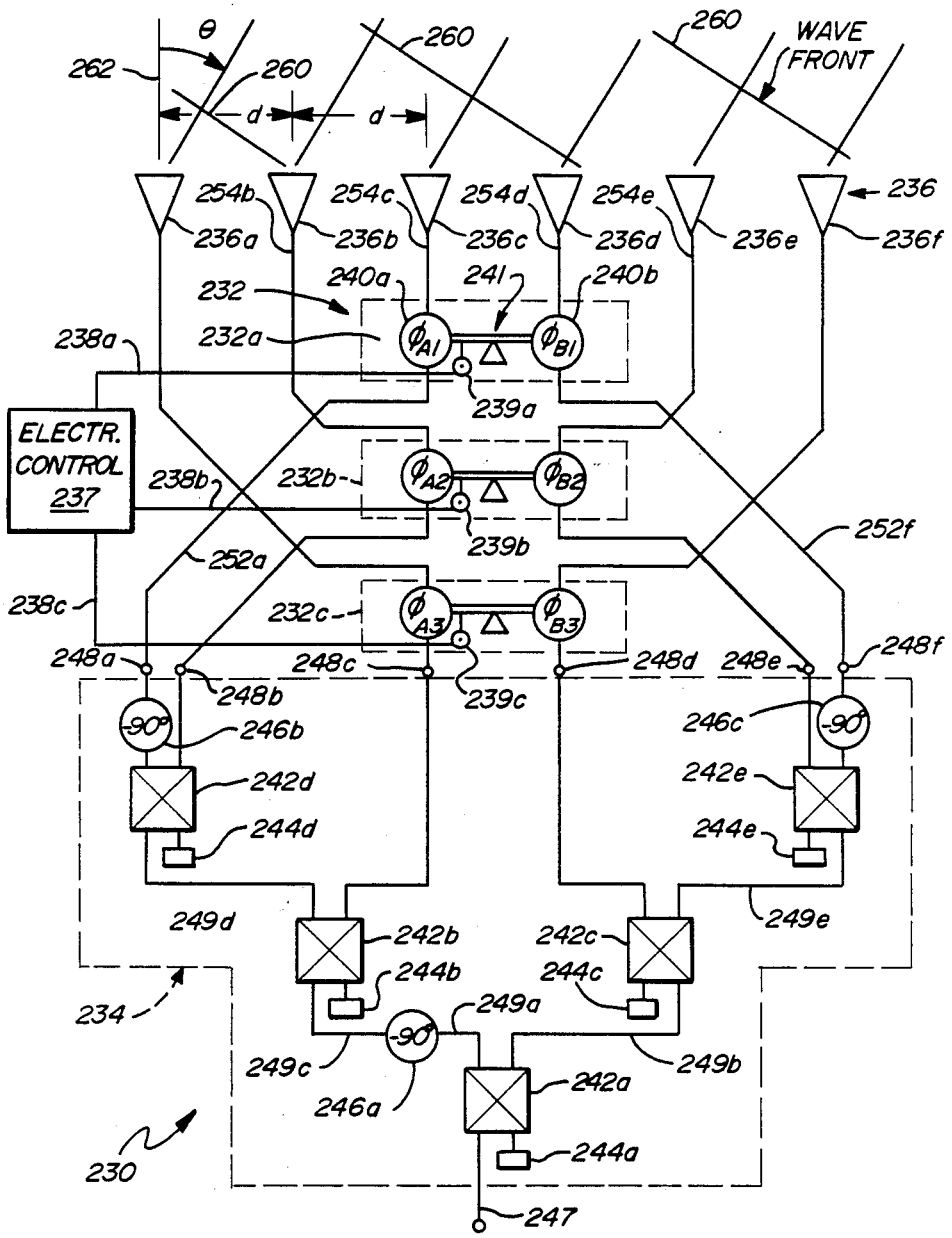
FIG. 15 is a simplified schematic diagram of a six radiating element phased array antenna system which includes three adjustable dual phase shifters of the present invention which are operable in an analog manner and disposed between a corporate feed network and the six element array.
Figure 16:
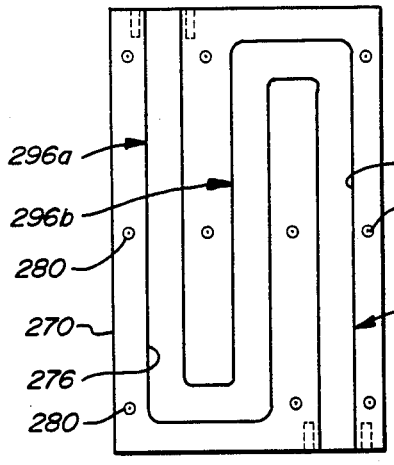
FIGS. 16 and 17 are top and front view of the body for a typical phase-shifting apparatus employed in a dual phase shifter of FIG. 15, with the cavity of the S-shaped outer conductor of the apparatus shown in dotted lines.
Figure 18:
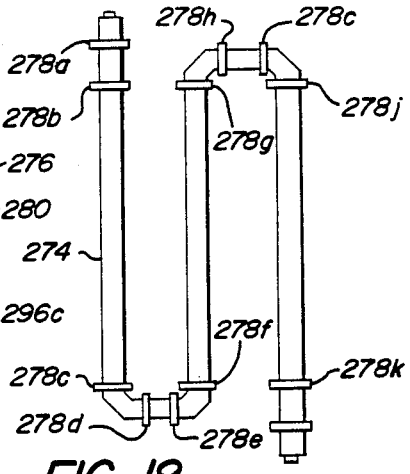
FIGS. 18 and 19 are top and front view of a typical inner conductor to be installed in the cavity of the FIG. 16 body and cover, with the dielectric spacers therefor shown in FIG. 18 only.
Figure 17:
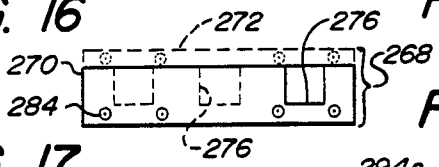
Figure 19:
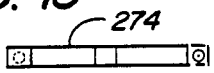
Figure 20:
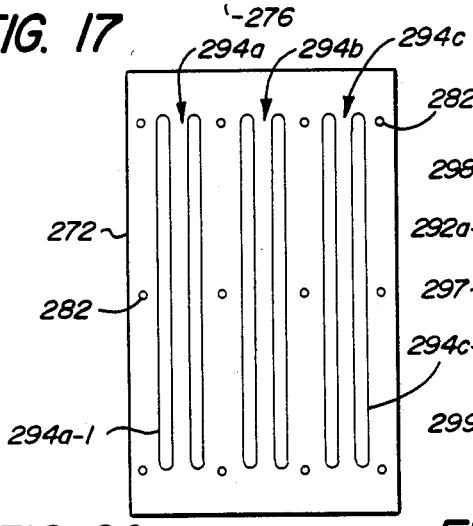
FIGS. 20 and 21 are top and front views respectively of a typical cover for the FIG. 16 body.

FIGS. 15 through 27 illustrate a second phase shifter of the present invention which is constructed from a second phase-shifting apparatus of the present invention which is somewhat different from the phase-shifting apparatuses 42*a*–42*e* and which utilizes analog control, so that any selected phase shift within a substantially continuous predetermined range of phase shifts can be produced thereby as desired. FIG. 15 is a schematic diagram illustrating an important application for the second phase shifters of the present invention. FIGS. 16–24 illustrate the details of construction of the base structure and pairs of projections used in two phase-shifting apparatuses within this second phase shifter, while FIGS. 24–27 illustrate the mechanical construction and analog operation of the two phase-shifting apparatuses and the second phase shifter.

FIG. 15 shows in schematic diagram form a six radiating element phased array antenna system 230 which inlcudes a set 232 of three adjustable analog dual-phase shifters 232*a*, 232*b*, and 232*c* disposed between a signal distribution network 234 and the array 236 of sic radiating elements 236*a*–236*f*. The set 232 of phase-shifting mechanisms 232*a*–232*c* is operated under the control of an electronic controller 237 which sends appropriate signals over conductors 238*a*–238*c* to three electrically-operated actuators 239*a*–239*c* which are preferably conventional stepper motors as will be further described.

The construction of each of the phase shifters 232*a*–232*c* is identical, and therefore only the construction of phase shifter 232*a* will be described. Phase shifter 232*a* includes a pair of phase-shifting apparatuses 240*a* and 240*b* which are operated together by a common see-saw linkage mechanism 241, which in turn is actuated by the stepper motor 239*a*.

Before describing the construction of the phase shifter 232*a*, it is useful to briefly review the remainder of FIG. 15. The signal distribution network 234 is preferably a conventional corporate feed network such as the one shown within the dotted lines of block 234, which includes five 90 degree phase lag hybrid couplers 242*a*–242*e*, five signal termination devices, 244*a*, 244*e* and three −90 degree fixed phase shifters 246*a*–246*e* connected between a common first port 247 and five second ports 248*a*–248*e* as shown by conventional or suitable transmission lines 249*a*–249*k*. The corporate feed network 234 is preferably constructed of passive microwave components so that it is substantially lossless and reciprocal, as are the phase shifters 232*a*232*c* and radiating elements 236*a*–236*f*, so that the antenna system 230 cna be used to transmit or receive microwave signals in a manner well-known to those in the antenna system art. The operation of corporate feed network 234 may be briefly explained by way of the following example. Assume a signal to be transmitted is applied to first input 247. This signal is distributed by hybrid coupler 242*a* with the unchanged output appearing on line 249*a* and a 90 degree phase lag output appearing upon line 249*b*. Phase shifter 246*a* adds a 90 degree phase lag to the signal on line 249*c*. Hybrid couplers 242*b* and 242*c* add another 90 phase lage to the signals from lines 249*c* and 249*b* respectively, so the signals at second ports 248*c* and 248*d* are shifted −180 degrees from the input signal. The hybrid couplers 242*d* and 242*e* impart a 90 degree phase lag to the signals from lines 249*d* and 249*e* so that the signals delivered to second ports 248*b* and 248*e* also each have a combined phase shift of −180 degrees. Finally, the fixed phase shifters 246*b* and 246*c* each impart a −90 degree phase shift so that the signals delivered to second ports 248*a* and 248*f* also each have a total phase shift of −180 degrees. Thus, the signals output on second ports 242*a*–248*f* are all in phase with one another and of equal strength.

The signals emanating from second ports 248*a* and 248*f* are applied via transmission lines 252*a* and 252*f* to the dual first ports of phase shifter 232*a*, wehre they are shifted in phase by equal but opposite amounts by phase-shifting apparatuses 240*a* and 240*b* and thereafter directed by transmission lines 254*c* and 254*d* to radiating elements 236*c* and 236*d* respectively. Similarly, the signals emanating from second ports 248*b* and 248*e* are provided with equal but opposite phase shifts by phase shifter 232*b* before being delivered via lines 254*b* and 254*e* to radiating elements 236*b* and 236*e* respectively. Finally, the singals from second ports 248*c* and 248*d* are provided with equal but opposite phase shifts by phase shifter 232*c* before being delivered to radiating elements 236*a* and 236*f*. It is well known that in a phased array antenna system, the resultant beam produced by the radiation emanating from the array 236 of ports will have a predetermined direction based upon the incremental phase shift or time delays existing between the signals applied in parallel to radiating elements 236a–236f. This may be better understood by reference to the top of FIG. 15, which shows a series of wavefronts 260 emanating from the array 236. The center-to-center spacing between the radiating elements of linearly arranged array 236 may be defined as the distance "d". The resulting antenna beams has an angular tilt of $\theta$ where $\theta$ is defined as the beam scan angle, that is, the angle of the plane of the wavefronts 260 from the normal 262 of the transmit beam center. The incremental phase shift produced by the set 232 of phase shifters is $\Delta\Phi$. The relationship between the incremental phase shift and the beam scan angle given by the well known formula:

$$\Delta\Phi=(2\pi d/\lambda)\sin\theta$$

where $\lambda$ is the signal wavelength of the wavefront 260 and d is defined as indicated above. Hence, the steered direction of the antenna beam is determined by the incremental phase shift which is controlled by the phase shifters 232. The phase difference betwen signals delivered to adjacent radiating elements 236 is preferably identical. This is achieved, in one example, by having the phase-shifting apparatus 232a shift the signal applied to elements 236c and 236d by +45 and −45 degrees respectively, the phase shifter 232b shift the signals applied to elements 236b and 236e by +90 degrees and −90 degrees respectively, and the phase shifter 232c shift the signals applied to elements 236a and 236f by +135 degrees and −135 degrees respectively. Those in the art will appreciate that other similar combinations of phase shifts are possible.

FIGS. 16–21 show components used in the base structure 268 of phase shifting apparatuses 240a and 240b illustrated in FIGS. 24 and 25. The components include a rectangular metal body 270 and a rectangular slotted metal cover 272. An S-shaped inner conductor 274 to be inserted in the correspondingly shaped cavity 276 of the body 280 and spaced from the sidewalls of the cavity by dielectric spacers in the same manner as disclosed in the first embodiment in FIGS. 1–13. The spacers 278 on inner conductor 274 are arranged in pairs, as in the first embodiment of the phase-shifting apparatus of the present invention, and the indivdiual members of the pair of dielectric spacers are one-quarter wavelength apart as in the first embodiment. The holes 280 and 282 shown in the body and cover respectively are to allow appropriate fasteners, such as pins or screws, to connect the body and cover together. The holes 284 shown in FIG. 17 in the body 270 are to enable suitable transmission line connections to be made to the base structure 268 comprised of body 280 and cover 272 in the manner shown in FIGS. 1 and 2 of the first embodiment.

Figure 22:
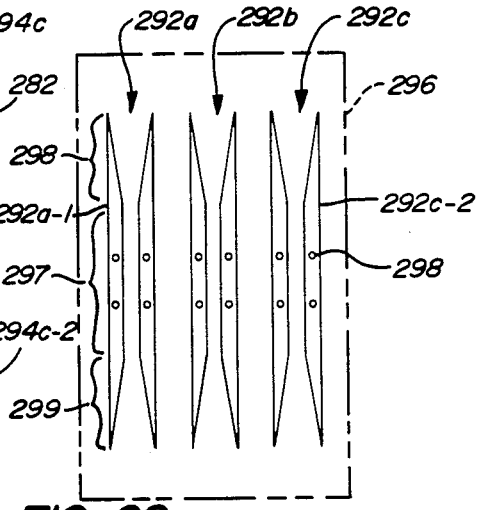
FIGS. 22 and 23 are top and front views respectively of three pairs of phase change projections insertable through corresponding pairs of slots in the FIG. 20 cover.
Figure 21:
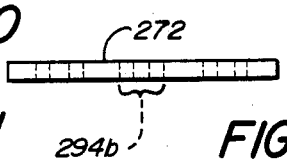
Figure 23:
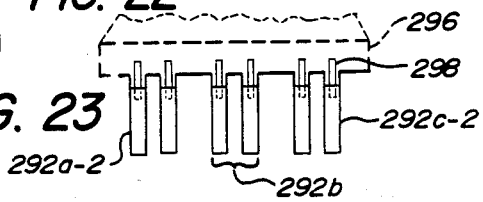

FIGS. 22 and 23 show the top and side views respectively of the pairs 292a, 292b, and 292c of the thin, elongated, outwardly tapered dielectric projections which are reciprocably insertable into the cavity 276 of the body 270 through the correspondingly sized pairs 294a, 294b and 294c of elongated slots in the cover 272, which are positioned above the three long portions 296a, 296b, and 296c respectively of the cavity 276. The projections 292a-1 through 292c-2 each include a sufficient number of fasteners 298 to allow them to be rigidly fastened to the support plate 296. As shown in FIGS. 22 and 23, the three pairs of projections 292 are moved in unison by moving the metal support plate 296.

Each of the projections 292 has a central region 297 of rectangular cross-section and uniform thickness and opposed end regions 298 and 299 which are wedge-shaped so that they are gently taper outwardly from the inner conductor 274 in operation. The purpose of the tapering is to provide for reduced reflections and smoother transition of a microwave signal passing through the outer conductor formed by the cavity 276 and confronting surface of the cover 272 as the microwave signal passes between the air or vacuum dielectric to the solid material dielectric within the projections 292. As before, the projections are preferably made from ULTEM Series 1000 resin available from the General Electric Company. The wedge shape of regions 298 and 299 require greater length than does the corresponding stair-step design of the projections 102 in the first embodiment of the present invention.

The projection pairs 292a, 292b and 292c are each designed to provide phase shift of −120 degrees when fully inserted into the cavity 276 of body 280. Because the cavity sections 296a, 296b and 296c are serially arranged, the three pairs of projections 292a–292c working in unison can provide substantially any degree of phase shift in a range of 0 degrees to minus 360 degrees, with the precise phase shift provided depending upon how far into the cavity 276 the projections 292 are inserted.

FIGS. 24 and 25 show a partially cut-away plan view and a partially cut-away side view of a typical analog dual-phase shifter 232 illustrated in block form in FIG. 15. The linkage structure 241 of shifter 232a includes an elongated first-class lever 300 of rectangular cross-section pivotably supported by pin 302 attached between mounting posts 304a and 304b. The lever 300 includes transverse elongated slots 306a and 306b equally spaced from the pivot pin 302. A cam pin 310 rotatably journaled in transverse throughhole 312 and transversely constrained by press-fit annular spacers 314a and 314b is provided to continuously engage the perimeters of cams 320a and 320b which are rigidly connected to cam shaft 322 which is coupled to and driven by output shaft 324 of stepper motor 239a. The cam shaft 322 passes through and is rotatably supported by mounting posts 328a and 328b which are attached to support base 298. A tension spring 330 connected between spring clips 332a and 332b respectively connected to the end extension 334 of lever 300 and the base 298 therebelow ensures that the cam pin 310 will continually bear against the cams 320a and 320b.

The phase-shifting apparatuses 240a and 240b shown respectively on the left-hand side and the right-hand side of FIGS. 24 and 25 are identical in construction. Therefore, only the apparatus 240a will be discussed in detail. The apparatus 240a includes a stationay guide structure including two upright posts 340a and 340b having an elonaged neck sections 342a and 342b to which are rigidly connected two horizontally positioned spaced guide rods 344a and 344b for the purpose of preventing horizontal movement of the movable support structure 348a of the apparatus 240a. The movable support structure 348 includes two elongated, upright guide rails 350a and 350b, each of which have a pair of elongated slots 352 therein, such as slots 352a-1 and 352a-2, shown on the left-hand side of FIG. 25. The guide rods 344a and 344b are disposed in these slots as shown and prevent horizontal movement and allow vertical reciprocating movement of the support structure 348a produced by movement of lever 300 which occurs when cams 320 rotate under power provided by stepper motor 239*a*. The transverse, horizontally positioned link pin 360*a* passes through elongated slot 306*a* in the first-class lever 300, and the ends thereof are captive in complementary bores in guide rails 350*a* and 350*b* so that movement of the first-class lever about its pivot pin 302 raises or lowers the pin 360*a* in the same direction as the first section 300*a* that the first-class lever is moving, while link pin 360*b* is moved in an equal and opposite direction. Rigidly connected to and supported by the guide rails 350*a* and 350*b* is the support plate 290 to which the pairs 292 of projections are attached. As best shown in the left-hand side of FIG. 25, the individual projections of the projection pairs are slidably positioned on either side of the inner conductor and may be raised out of the cavity or lowered further into the cavity by movement of the first-class lever 300 in response to the driving force provided by the stepper motor 239*a*.

The operation of phase shifter 232*a* will now be explained further by referring to the large view of cam 320*a* in FIG. 26 and the table 370 in FIG. 27. When the first class lever 300 is in a horizontal position, as illustrated in FIG. 25, the projections 292 are inserted precisely halfway into the cavity 276. Accordingly, a phase shift of −180 degrees is produced by both phase-shifting apparatuses 240*a* and 240*b*. In table 27, this condition of −180 degrees in each phase shift is normalized to 0 degrees. In a prototype of the present invention, designed for shifting the phase of microwave signals in a selected portion of the C band, that is, from 3.7 GHz to 4.2 GHz, the inner conductor has a cross-section of 0.2 inches square and an outer conductor 0.5 inches square to achieve an impedance of 50 ohms. Assuming that the phase-shifting apparatus 240*a* shown in FIGS. 24 and 25 has those dimensions, then the total length of stroke or reciprocating movement to move the projections 292 between a fully lowered or inserted position to a fully raised or withdrawn position is 0.5 inches. Since the cam pin 310 is located halfway between the pivot pin 302 and the link pin 360*a*, the identical cams 320*a* and 320*b* must move the pin 310 half of that distance or 0.25 inches to achieve this result.

The stepper motor 239*a* may be of any conventional or suitable type and may have an integral position-sensing mechanism such as a shaft encoder or resolver to ensure proper positioning in accordance received commands. A stepper motor which requires 360 pulses per revolutions, or one pulse per degree of rotation of shaft 324, may be used. Those in the art will thus appreciate based upon FIGS. 26 and 27, that for each pulse of the stepper motor in the counteclockwise direction between the angles of 0 mechanical degrees of cam 320*a* and 324 mechanical degrees, the diameter of the cam linearly increases. This is illustrated by the linear increase in the diameter of the cam S320 as mechanical angle of the cams are changed from step or position S36 to step or position S324. Note that the "A" and "B" normalized signal phases associated respectively with apparatuses 240*a* and 240*b* change at twice the rate of the changes in the mechanical angle between positions S36 and S324. In the segment of the cam 320*a* which extends from position S324 to position S0, the cam is returend to its normal position. Moreover, as can be seen from the table 370, the radius of cam 320*a* is constant from 0 mechanical degrees to 36 mechanical degrees.

Those skilled in the art will readily appreciate that the mechanical cams 320 may be made within any king of curve within the limits of motion of the projections 292 in the vertical direction. The stepper motor 239*a* may be operated to provide a continuously varying phase shift or may be given so many pulses to bring the projections 292 of apparatuses 240*a* and 240*b* to desired predetermined positions to produce a predetermined pair of phase shifts. Those in the art should also appreciate that the length of the body 270, the cavity therein and cover may be increased, and the length of the projections 292 correspondingly increased, so that larger or smaller phase shifts may be produced by the phase-shifting apparatuses of the present invention. Referring again to FIG. 15, phase shifts having differing ranges could be utilized with phase shifters 232*a*, 232*b* and 232*c*. For example, the maximum normalized phase shift produced by phase shifter 232*a* could be +180 degrees to −180 degress. As shown in FIGS. 24–27, the phase shifter 232*b* could be given a different cam to provide phase shifts between −360 degrees to +360 degrees, and the phase shifter 232*c* could be lengthened and provided with the same cam as phase shifter 232*b* provide phase shifts from −480 degrees to +480 degrees.

The foregoing embodiments of the present invention have been described with respect to a phase-shifting apparatus and digitally-controlled or analog-controlled phase-shifting apparatuses to operate in the range of microwave frequencies at or near the C band. Those in the art will appreciate that the phase-shifting apparatuses and digital and analog phase shifters of the present invention may be readily adapted for use in higher or lower microwave bands anywhere in the range from approximately 1.0 GHz up to 20 GHz. Although the present invention could be used with frequencies below 1 GHz or above 20 GHz, the relative dimensions of the parts become rather large or small, thus limiting the utility of the device due to size or manufacturing costs considerations.

It is to be understood that the above-described embodiments of the present invention are illustrative only, and that changes may be made in form and detail without departing from the spirit and scope of the invention. As a first example, although the base structures of the phase shifters have been shown to be of two piece construction, they can at least in certain circumstances be fabricated as a unitary block of material such as metal. For instance, if the phase shifter were an in-line design where the cavity forming the outer conductor makes no turns, the body and cover means therefor could be fabricated as a metal tube of rectangular cross-section and access to the cavity could be provided by boring or otherwise cutting elongated holes through one side of the tube to provide the necessary openings so that dielectric-loaded projections could be inserted into the cavity. As a second example, instead of using air or vacuum as the dielectric between the inner and conductors of the transmission line passing through the conductor, any other dielectric substance could be inserted therein except in the spaces where the dielectric-loaded projections need to be inserted. Those skilled in the art will appreciate that in such an alternative construction, movement of its projections into or out of their respective cavity portions will produce a change in the value of the net dielectric constant of the cavity portions, thus causing the phase of the signal passing therethrough to shift, just as in the embodiments of the present invention illustrated in the Figures herein. As a third example, the operaiton of the solenoid actuators 44*a* and 44*e* could be reversed by reversing the direction that the springs therein that bias the shaft, so that the energization of the solenoid coils would be required to retract the projections 102 from the cavity 66. In such a construction, energizing any given solenoid coil would produce a positive, rather than negative, phase shift. Other modifications to the phase shifting apparatuses of the present invention beyond those already mentioned herein are also clearly possible. Accordingly, it is to be understood that the protection sought and to be afforded hereby should be deemed to extend to the subject matter defined by the appended claims, including all fiars equivalents thereof.

What is claimed is:

1. An adjustable phse-shifting apparatus for use in shifting the phase of a microwave signal being transmitted along a transverse electromagnetic transmission line of the type including an inner conductor, a coaxial outer conductor, and a first dielectric located between the conductors, the apparatus comprising:

a body having an elongated cavity therein which forms at least part of the outer conductor;

cover means, attached to the body, for forming at least part of the outer conductor, and having at least a first elongated opening therein which provides access to at least a first portion of the cavity; and first member means for altering the phase of the signal as it passes through the first portion of the cavity, the first member means being provided with at least a first section including a second dielectric that is movable with respect to the first portion of the cavity in a direction transverse to the direction of the singal as it passes through the first portion to alter the phase of the signal, said first section including spaced apart projections respectively insertable into a position on opposite sides of at least a first segment of the center conductor.

2. The apparatus of claim 1, wherein the first dielectric of the transmission line is primarily either a gas or vacuum, and the inner and outer conductors of the transmission line have substantially square cross-sections, and said projections are thin and extend substantially parallel to each other.

3. The apparatus of claim 2, wherein each projection has a central region and pair of opposed end regions, with each of the end regions being tapered outwardly from the central region, thereby reducing the abruptness of the transmission for the signal as the signal passes between the gas or vacuum dielectric and the projections.

4. The apparatus of claim 3, wherein each of the end regions are wedge-shaped.

5. The apparatus of cliam 3, wherien each of the end regions includes a plurality of contiguous segments having distinctly different substantially uniform thickness, with each segment further from the central region being less thick than segments closer to the central region.

6. The apparatus of claim 3, wherien the central region of each projection includes an aperture sized to help rpvodie an impedance match between the first section and the transmission line.

7. The apparatus of claim 2, wherein the projections are movable between a first position wherein the projections extend substantially all the way between two opposed surfaces of the square outer conductor in the vicinity of the first portion of the cavity, and a second position where the projections are substantially fully withdrawn from a first volume of space substantially enclosed by the outer conductor in the vicinity of the first portion of the cavity.

8. The apparatus of claim 1, wherein:

the cover means includes at least a first pair of spaced elongated openings parallel to one another and sized to accommodate snugly the projections, and the member means includes a support plate having a substantially planar surface from which the projections perpendicularly extend, located on the side of the cover means opposite the cavity.

9. The apparatus of claim 1, wherein:

the body and cover means are made primarily from dielectric material and are metalized in the vicinity of the cavity to form the outer conductor, and the center conductor is formed from dielectric material which has a metalized surface.

10. The apparatus of claim 1, wherien the cavity of the body means has at least a second elongated portion spaced from the first elongated portion of the cavity, and the cove rmeans has at least a second elongated opening therein which provides access to the second portion of the cavity, and the apparatus further comprises:

second member means for altering the phase of the signal as it passes through the second portion of the cavity, the second member means being provided with at least a first section including dielectric material that is movable with respect to the second portion of the cavity in a direciotn transverse to the direction of the signal as it passes through the second portion of the cavity to alter the phase of the signal.

11. A phase shifting apparatus for selectively imparting, in response to at least first and second input commands, a plurality of non-zero phase shifts to a microwave signal being transmitted along a transverse electromagnetic transmission line of the type including an inner conductor, a coaxial outer conductor, and a gas or vacuum dielectric located between the conductors, the inner and outer conductors both having substantially square cross-sections, the apparatus comprising:

a body having an elongated cavity therein which forms part of the outer conductor;

cover means, attached to the body, for forming part of the outer conductor, having at least first and second spaced pairs of elongated openings which respectively provide access to first and second spaced portions of the cavity, with each elongated opening spaced closely to and extending generally parallel to the other opening of its pair;

first phase changes means for selectively altering, in response to the first command, the phase of the signal as the signal passes through the first portion of the cavity, the first phase change means including a movable structure having at least a first section provided with a support region and at least two thin elongated projections including dielectric material which extend transversely from the support region and into respective openings of the first pair of openings in the cove rmeans and into a position respectively on opposite sides of the inner conductor so that the inner conductor is received between said projections, the projections being movable between two distinct positions with respect to the first portion of the cavity in a direction transverse to the direction of the signal as it passed through the first portion of the cavity to alter the phase of the signal; and second phase change means for selectively altering, in response to the second command, the phase of the signal as the signal passes through the second portion of the cavity, the second phase change means including a movable structure having at elast a first section provided with a support region and two thin elongated projections including dielectric material which extend transversely from the support region and into respective openings of the second pair of openings in the cove rmeans, the projections of the second phase change means being movable between two distinct positions with respect to the second portion of the cavity in a direction transverse to the direction of the signal as it passes through the second portion of the cavity to alter the phase of the signal.

12. The apparatus of claim 11, wherein:

the first phase change means includes electrically-operated actuator means for moving the movable structure to thereby move the projections thereof between their two distinct positions, and the second phase change means includes electrically-operated actuator means for moving the movable structure to thereby move the projections thereof between their two distinct positions, said projections of said second phase change means being movable into a position such that said projections are respectively disposed on opposite sides of the inner conductor.

13. The apparatus of claim 11, wherein:

the transmission line extending through teh apparatus i designed for use with at least one specific band of microwave frequencies between 1 gigahertz and 20 gigahertz, the phase shift produced by the first phase change means in a microwave signal transmitted through the apparatus at a frequency in the center of the specific band is about zero degrees when the projections of the first phase change means are in their first position and a first predetermined value the range between about −22.5 degrees and about −90 degrees when its projections are in their second position, the phase shift produced by the second phase change means in the microwave signal at the same frequency when the projections of the second phase change means are in their first position and a first predetermined value the range between about −22.5 degrees and about −90 degrees when its projections are in their second position, and the first and second means are selectively operable so that their projections may be in their respective positions simultaneously, so that in such instance a combined phase shift at least equal to the sum of the first and second predetermined values is imparted to the signal then being transmitted through the apparatus.

14. An adjustable phase-shifting apparatus controllable in an analgo manner for use in shifting the phase of a microwave signal being transmitted along a transverse electromagnetic transmission line of the type including an inner conductor, a coaxial outer conductor, and a gas or vacuum dielectric located between the conductors, the inner and outer conductors both having substantially square cross-sections, the apparatus comprising:

a structure having an elongated cavity therein which forms at least part of the outer conductor through which at least a first segment of the inner conductor passes and having at least a first elongated opening therein which provides access to at least a first portion of the cavity;

first means for altering the phase of the signal as it passes through the first portion of the cavity, the first means being provided with at least a first section including dielectric material that is movable with respect to the first portion of the cavity through multiple positions forming a substantially continuous range of positions to alter the phase of the signal, with such movement being in a direction transverse to the direction of the signal as it passes through the first portion, the first section of the first means being elongated and having at least one pair of thin elongated projections parallel and spaced from each other which are insertable on opposite sides of at least a part of the first segment of the inner conductor located within the first portion of the cavity; and control means for selectively placing the first section of the first member means in any predetermined one of the positions within the substantially continuous range of positions in response to an external command specifying such predetermined position.

15. The apparatus of claim 14, wherien the control means includes a mechanical linkage attached to the first member means, a movable mechanical cam movable through multiple positions forming a substantially continuous range of positions for moving the linakge, and electrical actuator means for selectively moving the cam to any predetermined one of the positions within it continuous range of position in response to the external command.

16. In a phased array antenna system of the type having an array of radiating elements spaced for one another in a predetermined manner, and a signal distribution network having a first port and a plurality of second ports, an improved phase-shifting mechanism for use in simultaneously shifting the phase of at least first and second microwave signals being transmitted between the first port and the array of elements along at least first and second distince tranverse electromagnetic transmission lines of the type including an inner conductor, a coaxial outer conductor, and a dielectric located between the conductors, the improvement comprising in combination ;

(a) a first phase-shifting apparatus including (1) a first structure through which at least a first portion of the first transmission line passes, provided with at least a first opening providing access to at least a part of the volume of the first portion of the first transmission line and (2) first means for altering the phase of the first signal as it passes through the first portion of the first transmission line, the first means being provided with at least a first section including dielectric material that is movable with respect to the first portion of the first line in a first direction transverse to the direction of the first signal as it passes therethrough, said first section including a pair of projections movable into a position respectively on opposite sides of the inner conductor;

(b) a second phase-shifting apparatus including (1) a first structure through which at least a first portion of the second transmission line passes, provided with at least a first opening providing access to at least a part of the volume of the first portion of the second transmission line, and (2) first means for altering the phase of the second signal as it passes through the first portion of the second transmission line, the second member means being provided with at least a first section including dielectric material that is movable with respect to the first portion of the second line in a second direction transverse to the direction of the second signal as it passes therethrough; and (c) mechanical means for connecting the first and second means together for simultaneous movement so that changes in phase shifts in the first and second signals passing through the first and second portions are substantially equal but opposite to one another.

17. The mechanism of claim 16, wherein the mechanical means include a see-saw linkage structure having a lever pivotable aobut a first axis, the lever being provided with first and second sections on opposite sides of the first axis, and the first means for altering of the first apparatus includes a movable structure for slidably supporting the first section of the first means for reciprocating movement with respect to the first portion of the first transmission line, the movable structure being connected to the first section of the lever, and the first means for altering of the second apparatus includes a movable structure for slidably supporting the first section of the means of reciprocating movement with respect to the first portion of the second transmission line, such movable structure being connected to the second section of the lever.

18. The mechanism of claim 17, wherien the lever is movable through multiple positions forming a substantially continuous range of positions to alter the phase shifts imparted to the first and second signals by the first and second means, and the mechanical means further includes control means for selectively placing the lever in any predetermined one of the positions within the continuous range of positions in response to an external command specifying the predetermined position.

19. The mechanism of claim 18, wherein the control means includes:

a mechanical cam rotatable through multiple positions forming a substantially continuous range of positions which engages and moves the first class lever in correspondence to the motion of the cam, and electrical actuator means for selectively moving the cam to any predetermined one of the positions within its continuous range of positions in response to the external command.

20. The mechanical of claim 19, wherein the electrical actuator means includes a stepper motor.

21. An adjustable phase-shifting apparatus for use in shiftint the phase of a microwave signal being transmitted along a transverse electromagnetic tranmission line of the type including an inner conductor, a coaxial outer condutor, and a first dielectrlocated between the conductors, the apparatus comprising:

a body having an elongated cavity therein which forms at least a part of the outer conductor;

cover means, attached to the body, for forming at least part of the outer conductor, and having at least a first elongated opening therein which provides access to at least a first portion of the cavity;

first member means for altering the phase of the signal as it passes through the first portion of the cavity, the first member means being provided with at least a first section including a second dielectric that is movable with respect to the first portion of the cavity in a direction transverse to the direction of the signal as it passes through the first portion to alter the phase of the signal, the body means having at least a second elongated portion spaced from the first elongated portion thereof, and the cover means having at least a second elongated opening therein which provides access to the second portion of the cavity;

second member means for altering the phase of the signal as it passes through the second portion of the cavity, the second member means being provided with at least a first section including dielectric material that is movable with respect to the second portion of the cavity in a direction transverse to the direction of the signal as it passes through the second portion of the cavity to alter the phase of the signal;

first actuating means for moving at least a first section of the first member means between two distinct positions which alter the phase of the signal by differing amounts; and second actuating means for moving at least the first section of the second member means between two distinct positions which alter the phase of the signal by differing amounts, whereby the apparatus is operable to provide at least three distinct states of phase shift to the signal.

22. The apparatus of claim 21, wherein:

the first and second portions of the cavity are straight and the cavity includes at least fist and second turn portions which separate the first and second straight portions of the cavity and provide a combined total of direction change of the cavity of at least about 180 degrees such that the path of the transmission line within the apparatus changes direction at least once and the first and second member means are spaced apart in a direction transverse to the first and second straight portions of the cavity.

23. The apparatus of claim 22, wherein:

the cavity of the body further includes at least a third straight portion and a third and fourth turn portions which separate the second and third straight portions of the cavity and provide a combined total of direction change of the cavity of at least about 180 degrees, and the first through fourth turn sections and first through third straight portions of the cavity are arranged such that the path of the transmission line through the apparatus has an S-shape.

24. The apparatus of claim 22, wherien:

the first and second member means are respectively rigidly mounted to and carried by the first and second acutating means, and the first and second actuating means each include solenoid operator means for selecting which of the two distinct positions the first section of its respective member means is in, whereby by the apparatus can be operated to select at least four states of the phase shift having different amounts of phase shift.

25. The apparatus of claim 24, wherein one of the states of phase shift is zero degrees of phase shift achieved by each of the actuating means fully retracting the first section of its respective member means from a volume of space substantially enclosed by the square outer conductor in the vicinity of its respective portion of the cavity.

26. An adjustable phase-shifting apparatus for use in shifting the phase of a microwave signal being transmitted along a transverse electromagnetic transmission line of the type including an inner conductor, an outer conductor, and a first dielectric located between the conductors, comprising:

a body having an elongated cavity therein within which the inner conductor is disposed, said body having an opening therein providing access to at least a portion of the cavity within said body; and, means for altering the phase of the signal as it passes through said cavity, including a second dielectric movable through said opening and in a direction transverse to the direction of the signal as it passesx through the cavity to alter the phase of the signal, said dielectric including a pair of spaced apart projections respectively insertable through said opening into a position on opposite sides of at least a portion of the inner conductor, so that the inner conductor is received between the projections.

* * * * *